US006877671B2

(12) United States Patent
Bruyn et al.

(10) Patent No.: US 6,877,671 B2
(45) Date of Patent: Apr. 12, 2005

(54) BETWEEN-RAILS ROADWAY FOR ROAD-RAIL CROSSINGS

(75) Inventors: Dominicus Bruyn, Cambridge (CA); Frank Drayton Williams, Waterloo (CA); Bill Wei Shiu Chien, Waterloo (CA)

(73) Assignee: Performance Polymers Inc., Cambridge (CA)

( * ) Notice: Subject to any disclaimer, the term of this patent is extended or adjusted under 35 U.S.C. 154(b) by 0 days.

(21) Appl. No.: 10/270,699

(22) Filed: Oct. 16, 2002

(65) Prior Publication Data

US 2003/0085292 A1 May 8, 2003

(30) Foreign Application Priority Data

Oct. 18, 2001 (GB) ..... 0125065

(51) Int. Cl.[7] ..... E01B 3/00
(52) U.S. Cl. ..... 238/8; 404/41
(58) Field of Search ..... 238/8, 2, 9, 5, 238/6; 404/40, 34, 41; 52/578, 579, 582.1, 582.2

(56) References Cited

U.S. PATENT DOCUMENTS 1,731,301 A * 10/1929 Emmons ..... 238/8
1,843,062 A * 1/1932 Bradley ..... 238/8
1,965,026 A * 7/1934 Bell ..... 238/8
1,979,790 A * 11/1934 Bell ..... 238/8
2,116,033 A * 5/1938 Malone ..... 404/71
2,137,566 A * 11/1938 Clare ..... 238/8
2,256,025 A * 9/1941 Hoak ..... 238/8
3,348,459 A * 10/1967 Harvey ..... 404/35
3,444,661 A * 5/1969 Santho ..... 52/376
3,572,224 A * 3/1971 Perry ..... 404/40
3,843,051 A * 10/1974 Whitlock ..... 238/8
4,093,120 A * 6/1978 Canfield ..... 238/8
4,368,845 A * 1/1983 Perry et al. ..... 238/8
5,201,467 A * 4/1993 Kennel et al. ..... 238/8
5,854,352 A * 12/1998 Chisholm et al. ..... 525/199
5,899,379 A 5/1999 Bruyn et al.

OTHER PUBLICATIONS

Untitled sketch, 1997, London, ON Canada, Performance Polymers Inc.

* cited by examiner

*Primary Examiner*—Mark T. Le
(74) *Attorney, Agent, or Firm*—Anthony Asquith

(57) ABSTRACT

The roadway at a road-rail crossing comprises rows of extruded rubber strips. The strips have a tongue-and-groove type of edge connection, which constrain the strips such that if one strip bounces the adjacent strips bounce too. Locking-strips fit between primary-strips, and have latches, which snap into place upon the locking-strips being driven downwards, from above.

24 Claims, 8 Drawing Sheets

BETWEEN-RAILS ROADWAY FOR ROAD-RAIL CROSSINGS

This invention relates to road-rail crossings, and is concerned with the manner in which the portion of the roadway that lies between the tracks is to be constituted.

GENERAL FEATURES OF THE INVENTION

In the kind of road-rail crossing with which the invention is concerned, it is conventional for rubber insert-strips to be placed in actual contact with the rails. Then, the between-rails-roadway may, for example, be formed by filling the gap between the rubber insert-strips with asphalt. An example of this approach is disclosed in patent publication U.S. Pat. No. 5,899,379.

One of the reasons using asphalt in the between-rails-roadway is not preferred in some cases is that much of the work has to be done on-site, which means that the crossing has to be closed for a long period and also, often, the period has to be extended unpredictably due to unforeseen hitches in the on-site work.

Another manner of forming the between-rails-roadway has been to provide a pre-fabricated slab or panel of concrete; again, the rubber insert-strips actually contact the rails, and the concrete panel is sized to fill the gap between the rubber insert-strips. One benefit of the use of pre-fabricated concrete panels is a shorter and more predictable crossing-closure time, for installation. However, the individual concrete panels typically weigh a ton, whereby a crane is required to lift and manoeuvre the panels into place.

Proposals have been made for forming the between-rails-roadway from a one-piece moulded-rubber panel. However, this has not been preferred because of the difficulty and expense of keeping the properties of the rubber even and homogeneous over the whole panel. Furthermore, although the rubber is lighter than concrete, it has hardly been practical to lift and manhandle the one-piece rubber panels without a crane.

Proposals have been made for forming the between-rails-roadway, not from pre-fabricated one-piece panels, but from several pre-fabricated strips. Each strip is light enough individually to be lifted down from a truck, and manhandled into position, by a work crew of practical size—say three or four workers.

The invention is concerned with a between-rails-roadway formed from individual strips, preferably which are formed of elastomeric material, and preferably from extruded rubber.

When the between-rails-roadway is to be constituted in the form of rows of separate strips, which are installed individually on-site, the designer should consider the following points. The distance the between-rails-roadway has to bridge, between the wheel-flange recesses, is about 130 cm. The strips rest on the cross-ties, and the distance from the tops of the cross-ties to the tops of the rails typically is about 20 cm. The strips have to provide a means for transferring the weight of passing vehicles onto the cross-ties. The ties on crossings typically are set at about one-metre pitch spacing, and the strips have to straddle or bridge across the space between adjacent ties, which, even when supporting a heavy truck, they must do basically without sagging.

The designer of the crossing should see that the strips do not bounce and rebound unduly when vehicles pass over the crossing. Preferably, the designer should not require that the strips be fastened down to the cross-ties at regular intervals. Rather, the resistance to bounce and rebound should come from the configuration of the strips, and from the manner in which the assembly of strips is arranged.

It would be preferred for the between-rails-roadway to be held in place without any fastenings to the ties whatsoever. However, some means will generally have to be provided for constraining the strips against the tendency of the strips, gradually over a long period of time, to wander lengthwise relative to the rails. Such anti-wander means usually involve fastening the strips to the cross-ties, or fastening an abutment to the cross-ties. Still, it is preferred that fastenings that involve actually making extra holes in the cross-ties be kept to a minimum.

To keep bounce and rebound to a minimum, the strips should be of such a profile that the bouncing and rebounding motion causes the strips to rub against each other, whereby the resulting friction dampens the motion. Rubber also has an inherent hysteresis when it flexes, which the designer should seek to harness, by so arranging the profiles that the bouncing and rebounding motions would involve some flexure. On the other hand, flexure cannot be too much, since a between-rails-roadway that sagged or deflected much more than an ordinary roadway when heavy trucks passed over it would not find favour.

As mentioned, the thickness or height of the between-rails-roadway material has to be about 20 cm. The strips should not weigh more than about 100 kg or so, if they are to be manhandled by a work crew of three or four workers. With the other considerations as will be explained below, this means that the between-the-rails roadway preferably may be constituted basically from six primary-strips, each of which is 20 cm high, and roughly 20 cm wide. These strips may each rest on top of the cross-ties, between the insert-strips that actually contact the rails.

Other numbers (of strips) are possible, but if the number of strips were fewer, each one of the strips would be wider, and therefore might be too heavy to manhandle; also, its profile might be too large to be extruded, and vulcanised, homogeneously. These difficulties set the lower limit of the number of primary-strips at about four, and, as mentioned, six is preferred.

More (and therefore narrower) strips may be provided to fill the gap between the rails. Narrower strips would be lighter, and easier to extrude; however, those benefits start to be negated by the bother of handling the extra strips. The strips should not be too light, however, in that they rest in place on the cross-ties under their own weight. Eight strips would be the practical upper limit, six being again the preferred number (for standard-gauge (56½") railways).

One of the main benefits of using separate strips for the between-rails-roadway lies in the reduction in the overall installation time, i.e the period of time between the crew taking the strips out of the delivery truck, and forming them into a robust and long-lasting finished roadway, and in the accomplishment of this task without the use of cranes or other special tools.

In the roadway systems as described herein, the (six) primary-strips are simply laid on the cross-ties; no measurements or careful fitting are called for. Locking-strips, which, in the roadway systems as described herein, hold the (six) primary-strips in the correct locations, are simply kicked or hammered into place, between the primary-strips. Also, in the systems as described herein, it is a simple matter for an inspector to ascertain, visually, that all the strips have been assembled properly, in that it would be immediately apparent to the inspector if any of the components of the roadway were missing, or had been assembled wrongly. Furthermore, the wrongness of a wrongly-installed roadway remains apparent; this may be contrasted with crossings that use an asphalt roadway, where mistakes can be covered up all too easily.

In the invention, preferably the strips are joined together edge to edge, and do not require the use of a straddling component that extends across laterally between the rails, to join the strips together. From the inspection standpoint, it would be a disadvantage if the between-rails-roadway required the use of components that straddled across laterally between the rails, underneath the strips, to hold the strips together, since it would not be easy for the inspector to ascertain if such a straddling component had been assembled properly.

It is recognised, in the invention, that the separate strips preferably should be locked together in such manner as to prevent vertical movement relatively, between adjacent strips. That is to say, there should be an interface connection between the strips, which serves the same function as a tongue-and-groove connection, constraining the strips against vertical (bounce and rebound) movement relative to each other.

However, the manner in which such connections can be assembled must be borne in mind. Of course, the railway tracks cannot be moved apart to permit insertion of the strips, and therefore not all the strip-to-strip interface connections can be of the type of tongue-and-groove connection that is assembled by bringing the components together in the lateral direction. At least one of the connections must be assemblable from above.

That is to say: at least the last-assembled one of the strips must be capable of forming a tongue-and-groove type of connection with its neighbouring strips, even though the last strip is assembled from above. In the exemplary designs as described herein, that is done by providing, in respect of at least the last-assembled interface connection between the strips, a flexible deflectable latching lever, which snaps under or onto a latch-ledge on the neighbouring strip. In fact, as will be understood from the designs as described herein, every one of the interface connections between the strips can be arranged to form a tongue-and-groove type of connection, using the deflectable latch-levers, such that all can be assembled from above.

DETAILED DESCRIPTION OF PREFERRED EMBODIMENTS

By way of further explanation of the invention, exemplary embodiments of the invention will now be described with reference to the accompanying drawings, in which.

Figure 1:
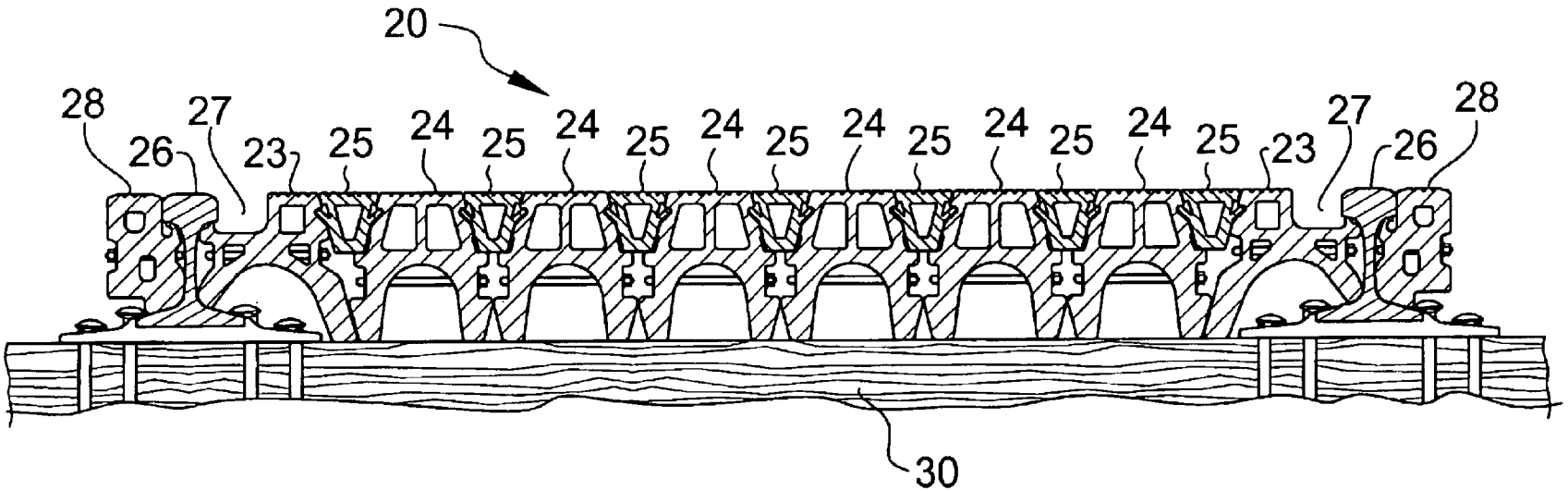
FIG. 1 is a cross-sectioned end elevation of a road-rail crossing, showing a between-rails-roadway which embodies the invention, the section being taken at right angles to the rails, viewed horizontally.
Figure 7A:
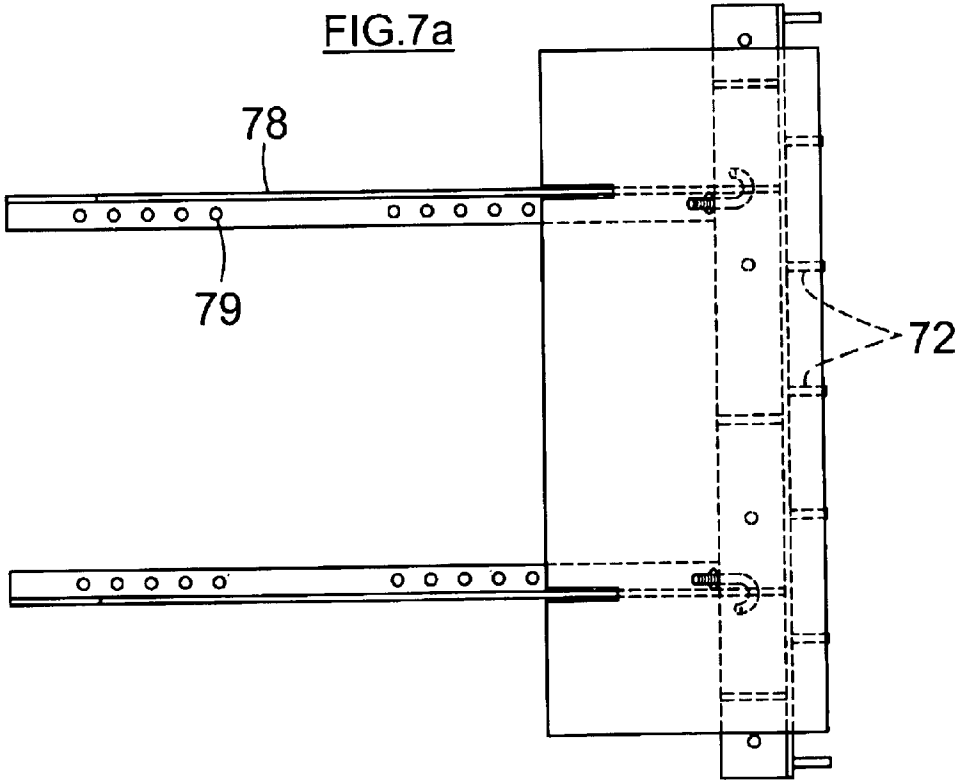
Figure 7C:
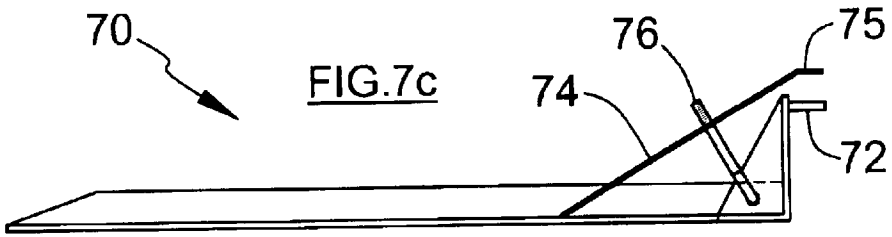
Figure 7B:
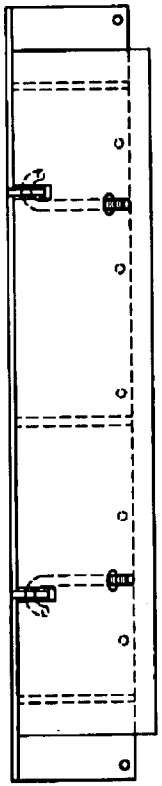

FIGS. 7*a*,7*b*,7*c* are plan, end, and side views respectively of an end-fixture for use with the between-rails-roadway of FIG. 1.

Figure 8:
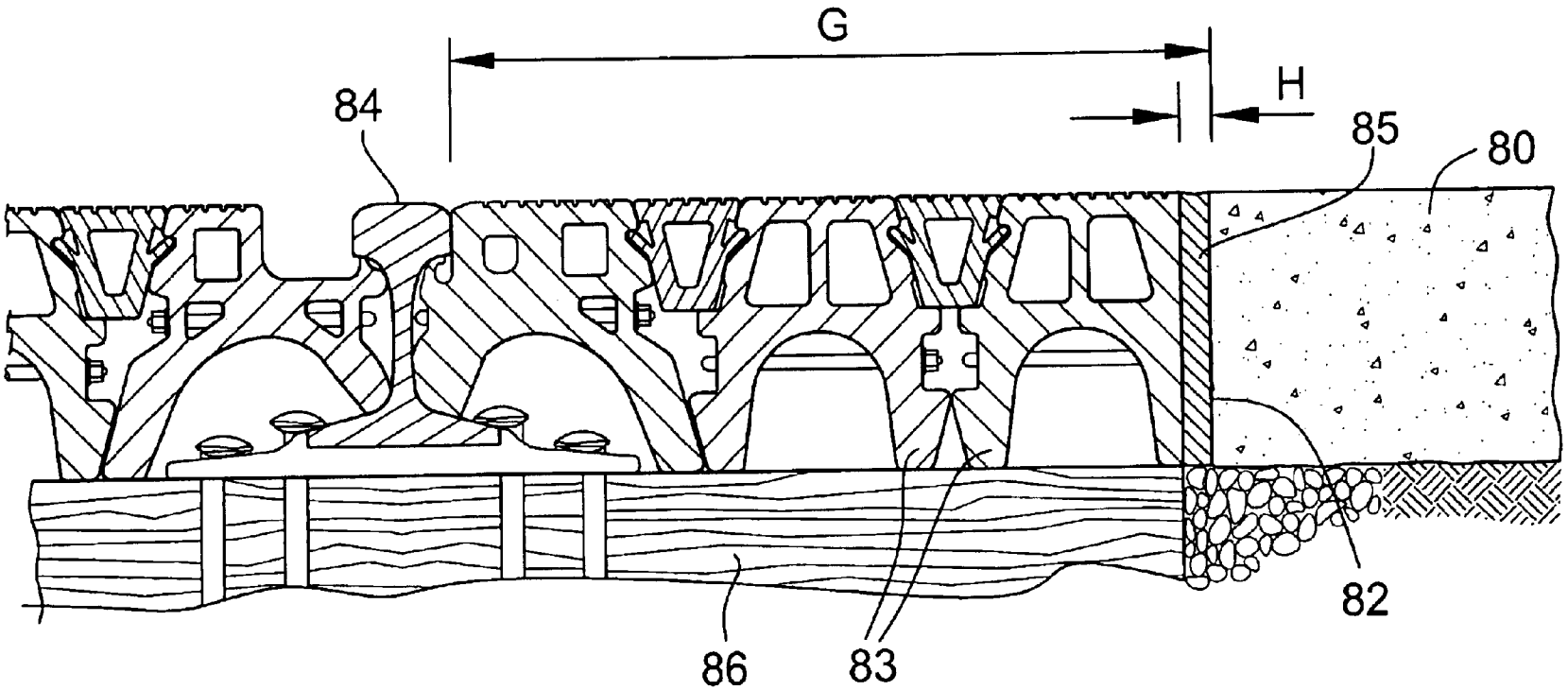

FIG. 8 is an end elevation of a road-rail crossing, showing a portion of roadway outside the crossing.

The apparatuses shown in the accompanying drawings and described below are examples which embody the invention. It should be noted that the scope of the invention is defined by the accompanying claims, and not necessarily by specific features of exemplary embodiments.

The road-rail crossing shown in FIG. 1 has a between-rails-roadway 20 that is formed from (a) two insert-strips 23; (b) six primary-strips 24; and seven locking-strips 25.

The left and right gauge-side insert-strips 23 engage directly against the gauge sides of the rails 26. The gauge-side insert-strips include cut-outs 27 for the wheel flanges of railway trains passing over the rails 26. Left and right field-side insert-strips 28 are also provided. The main roadway, i.e the roadway that lies outside and beyond the crossing, is formed e.g from asphalt or the like, in the conventional manner. The asphalt is poured after the field-side insert-strips 28 have been placed against the field sides of the rails 26, and the poured asphalt locks mechanically into the field-side insert-strips. The between-rails-roadway 20 is structurally independent of the said main roadway, and work on the between-rails-roadway 20 may be carried out independently of work on the main roadway.

The work of installing the between-rails-roadway 20 can be carried out simply and efficiently. First, the old roadway material has to be removed, and this task is much simplified if the old roadway is formed, as depicted herein, from individual strips, which can be lifted out individually. Once the old material has been cleared, the ballast checked, and other repairs and routine maintenance tasks done, the new roadway can be installed. Each strip weighs less than 100 kg, whereby the strip can be lifted down from a truck, and manhandled and manoeuvred into position by the work-crew, without the use of cranes or other special equipment.

The insert-strips 23 are installed first, as they have to be pushed into place, from a lateral direction, against the side-surfaces of the rails 26, i.e the side-surfaces of the webs of the rails. The other strips cannot be present while the insert-strip 23 is being installed into place between the head and flange of the rail.

Figure 2:
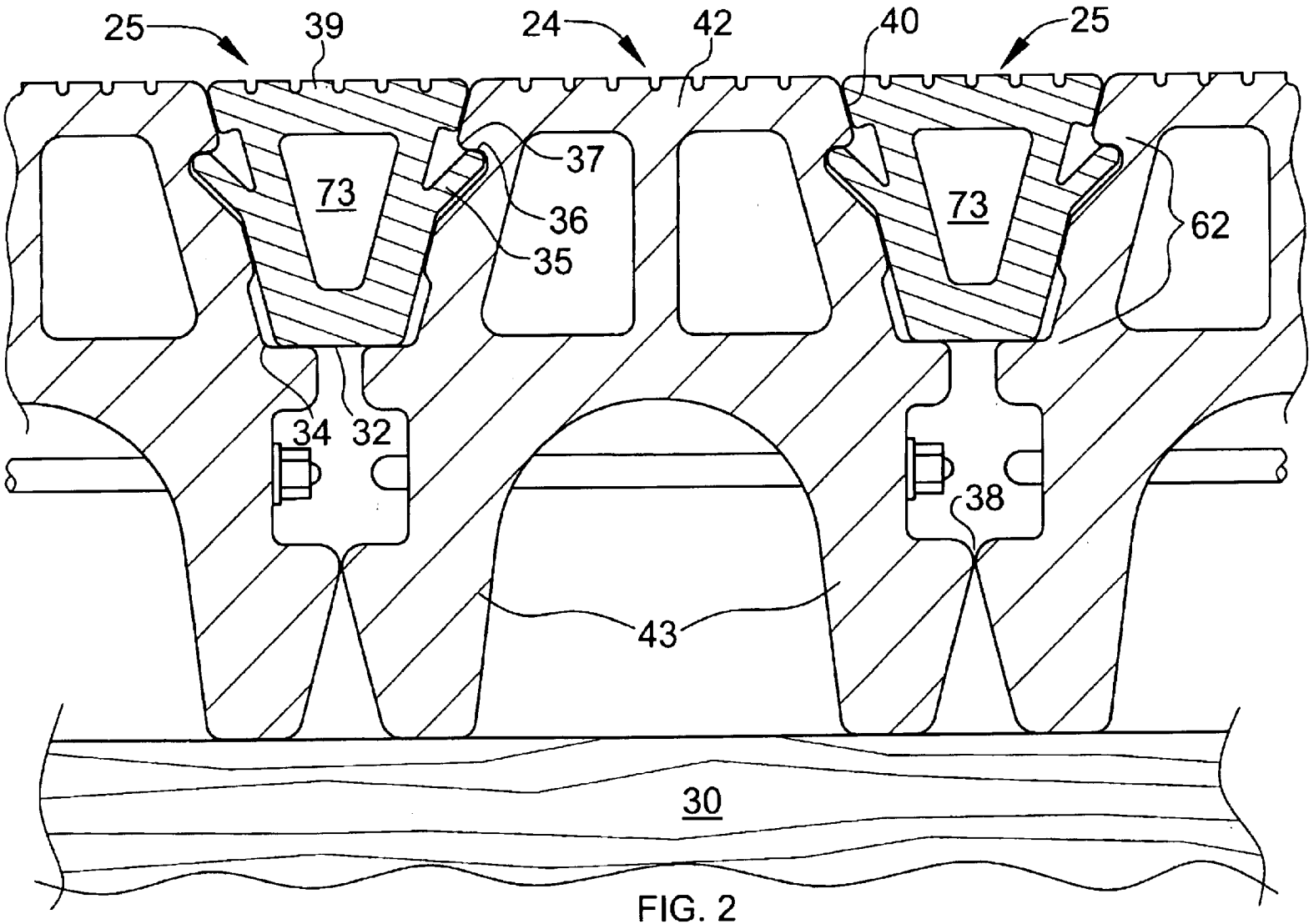
FIG. 2 is a close-up of an area of FIG. 1.
Figure 3:
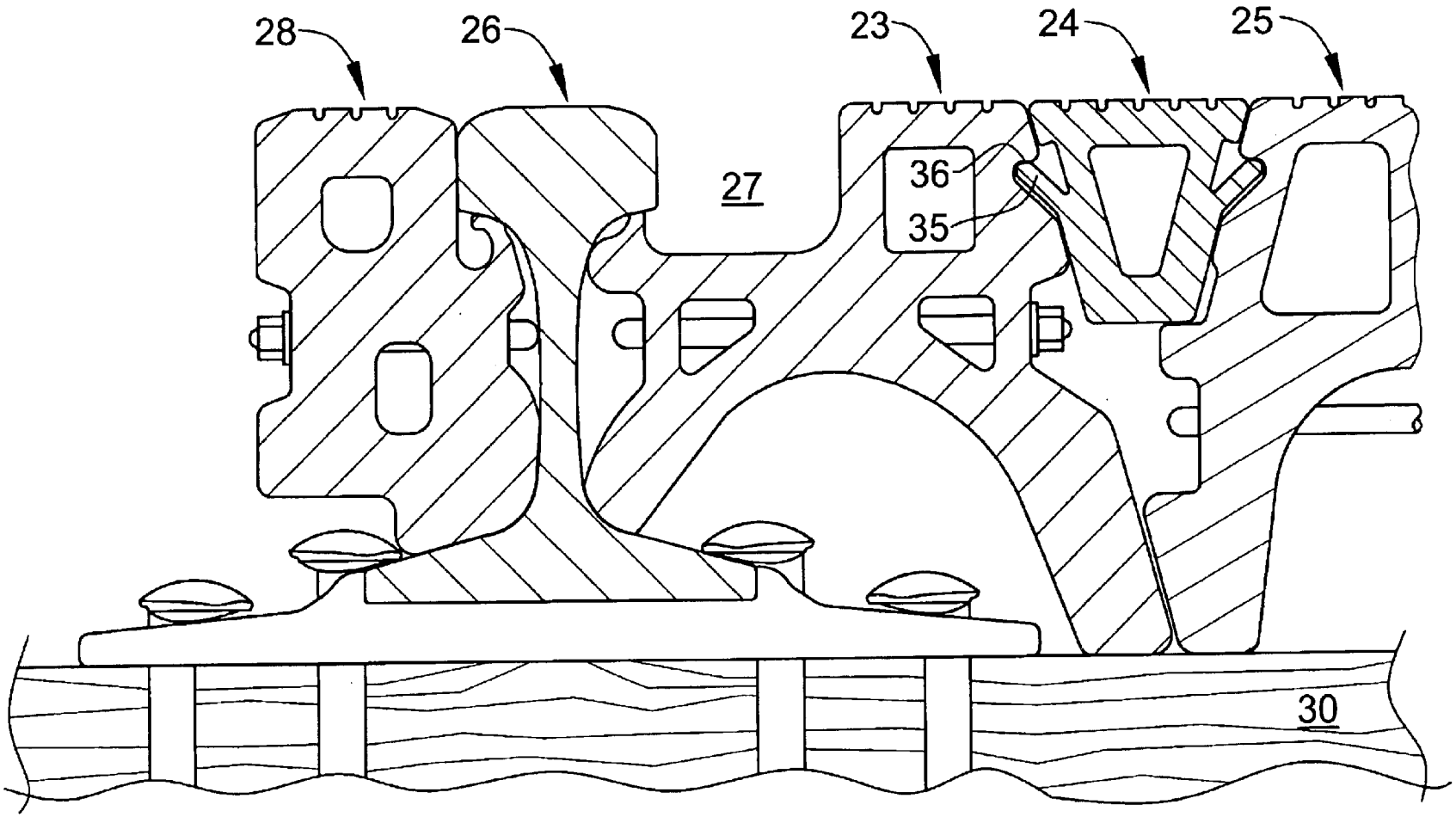
FIG. 3 is a close-up of another area of FIG. 1.

As shown in FIGS. 2 and 3, once both insert-strips 23 are in place, the six primary-strips 24 are then laid between the insert-strips 23. The primary-strips rest on top of the cross-ties 30. The cross-ties are pitched, typically at crossings, every eighty cm, and the tops of the ties usually stand a few cm clear of the surrounding ballast. The primary-strips 24 are un-supported underneath the portions of the primary-strips that span between the cross-ties 30. The primary-strips 24 should be dimensioned, as to the overall width of the strips, such that the six primary-strips just fill the gap left between the two insert-strips 23.

The primary-strips should not be designed to be so narrow that large gaps are present between the strips, since it would be hard to keep such gaps even.

Once all six primary-strips 24 are in place, the seven locking-strips 25 are installed. Each locking-strip has a bottom-face 32, which abuts an upward-facing abutment-surface 34, provided on the primary-strips, and in fact each locking-strip 25 abuts against the abutment surfaces 34 of two adjacent primary-strips 24.

Each locking-strip 25 carries left and right latch-levers 35. These latch-levers 35 are flexible, and are resiliently deflectable, whereby, as the locking-strip 25 is driven down between adjacent primary-strips 24, the latch-levers are deflected inwards. As the tip of the latch-lever 35 passes below the lip 37 on the primary-strip, the latch-lever springs outwards, and snaps into place, as shown, underneath the latch-ledge 36 of the primary-strip. The strips, being made of rubber, are inherently resilient and deflectable. However, on the scale of variations to which rubber can be formulated, the rubber used in strips for railway crossings typically lies at the hard and stiff end of that scale, and the levers should not be regarded as being floppy and easy to bend.

Five of the seven locking-strips 25 are inserted into position as shown between the six primary-strips 24, and the other two of the locking-strips are inserted between the primary-strips and the insert-strips 23.

It might be considered that, as the locking-strips are inserted, but before all the locking-strips are inserted, so the primary-strips can be expected to deflect and move sideways, and the function of the last-assembled locking-strip is to even up the relationships between the strips. Thus, it might be considered that it will become progressively more difficult to insert the locking-strips, the final locking-strip being especially difficult to insert. However, as mentioned, the strips are stiff enough that the strips substantially do not deflect sideways as the locking-strips are inserted, and it is hardly more difficult to insert the last locking-strip than the first.

The designer should arrange that the spaces at 38, between primary-strips, are preferably zero, or even negative, whereby the legs 43 of the primary-strips have to bend inwards slightly in order for them all to fit between the inset-strips.

The stiffness of the cross-sections of the strips means that it takes a good deal of force to insert all the locking-strips. Preferably, the locking-strips should be hammered in, which can keep the effects of friction between the strips to a minimum, as compared with pressing the locking-strips in with a steady force. It will be understood that once the crossing is in use, and trucks are repeatedly passing over the crossing, any unevenness of insertion between the locking-strips will tend to be very thoroughly evened out.

The abutting faces 32,34 and the latching components 35,36 holding the strips together should be tight, vertically, such that, once the locking-strips are latched in place, no vertical movement can take place, either up or down, relatively between adjacent strips. This is what is meant by referring to the connections between the strips as tongue-and-groove connections.

The designer should see that there is very little, and preferably no, slack clearance between the latches and the abutments, which might permit one strip to undergo some degree of vertical motion relative to its neighbour. Individual separate strips tend to bounce and rebound as vehicles pass over the crossing. It is the fact that the strips are tightly locked together, vertically, that enables a between-rails-roadway comprising individual separate strips to perform in an acceptable manner. The friction that also accompanies, or would accompany, any such movement, or tendency to such movement, is especially effective in damping and dissipating any bouncing and rebounding movement.

As mentioned, the designed tightness of the latches might mean that, upon first assembly, the tips of the latch-levers 35 might not immediately snap fully quite home into place under the latch-ledges 36. However, if so, that will soon be remedied automatically, because trucks passing over the crossing will press the locking-strip down, causing the latch-levers gradually to work their way more deeply into position underneath the latch-ledges.

Portions of the between-rails-roadway surface are constituted by the roofs 39 of the locking-strips 25. As shown, the roofs 39 have tapered edges 40, which engage correspondingly sloped edges to the roofs 42 of the primary-strips 24. As the locking-strips are forced downwards, relative to the primary-strips, the angled surfaces are driven more tightly together, thereby ensuring that the actual surface of the between-rails-roadway is tight and coherent. The friction of rubber on rubber is so great that the surfaces have little tendency to separate again, once having been driven together (given that the strips are all maintained in a row, laterally constrained between the rails.) It is not out of the question that the resulting roadway surface, even though made up of fifteen separate pieces (FIG. 1), might actually be substantially watertight, i.e precipitation water cannot penetrate down through the surface, which is an aid to the between-rails-crossing having a long service life.

The rubber strips as described are manufactured by extrusion. As such, the cross-sectional shapes of the strips can be intricate, and can include internal hollow cavities. So long as the circumscribing circle of the extrusion profile is less than about 25 or 30 cm, the properties of the extrusion can be controlled, and kept uniform over the whole profile, to an acceptable degree. Although it is preferable for the thickness of the sections of rubber to be uniform over the profile, variations in thickness of the sections, can be accommodated, as may be seen in the drawings. The extrusion process is highly suited to the task of producing a profile that is sturdy enough to stand up to the heavy loads applied to the strips, and yet which can be sculpted to reduce weight, and can include elements like the latch-levers 35, which are thin enough to be flexible.

The vertical distance between the top of the cross-tie and the top of the rails is about 20 cm, and a profile of that height, with controllably-homogeneous properties, can be readily extruded if the width of the profile is less than about 20 cm, and the diameter of the circumscribing circle is less than about 25 cm. Thus, if the strips are to be manufactured by extrusion, preferably the maximum width of the strip should be no more than about 20 cm. That is to say, the spread of the legs 43 of the primary-strip 24 should be no more than about 20 cm wide.

As mentioned, the strips can be expected to have a tendency to bounce and rebound as vehicles pass over the crossing, whereby the legs 43 of the primary-strips will tend to break contact with the cross-tie 30. Therefore, the primary-strips will have a tendency to become displaced, and especially might tend to roll or tip over, as vehicles pass over the crossing; and the designer must see to it that the primary-strips do not do this. It is recognised that packing the strips tightly together reduces the tendency of the strips to tip, and another effective ploy is to make the roadway portion of each strip substantially narrower than the spread of the legs of that strip.

When the wheel is on the roadway surface of the roof 42 of the primary-strip, the load from the wheel is spread evenly between the sturdy, wide-spaced legs 43 of the primary-strip. The locking-strips rest between the primary-strips, so when the wheel is on the roadway surface of the roof 39 of the locking-strip, the load from the wheel is spread between the adjacent two primary-strips. So, at each point, the tendency of the load to apply a force to the strips that might tip the strips, is kept to a minimum. However, if the roof of the primary-strip were wider, the possibility that the primary-strip might tip might be larger.

Figure 4:
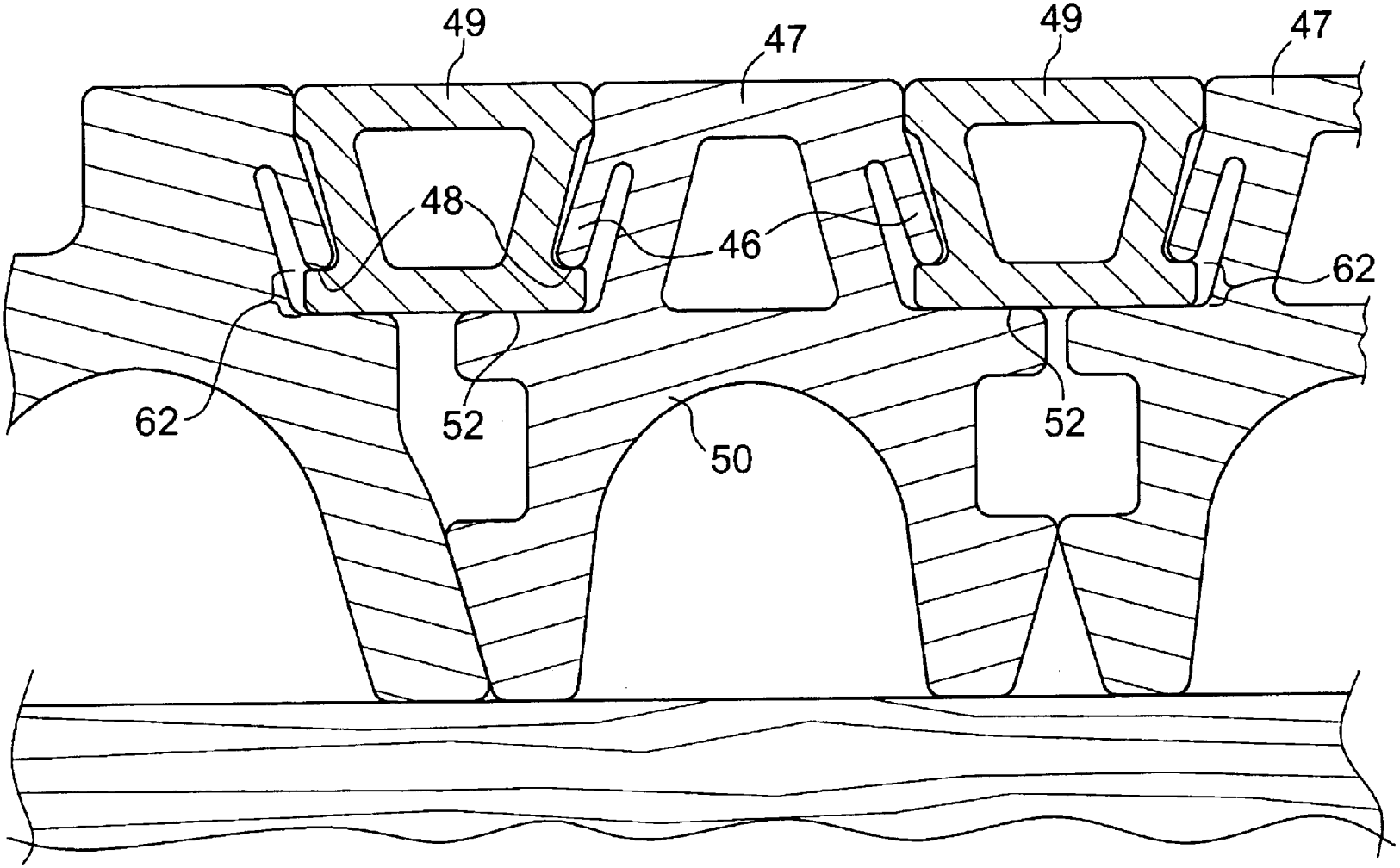
FIG. 4 shows another between-rails-roadway that embodies the invention.

FIG. 4 shows another embodiment. Here, the latch-levers 46 point downwards, and are formed into the primary-strips 47, and the latch-ledges 48 on the locking-strips 49. In FIG.

4 (as in FIG. 1) the primary-strips comprise what may be described as a two-tier viaduct, in that large arches 50 support a platform 52, on which the locking-strips 49 rest.

Figure 5:
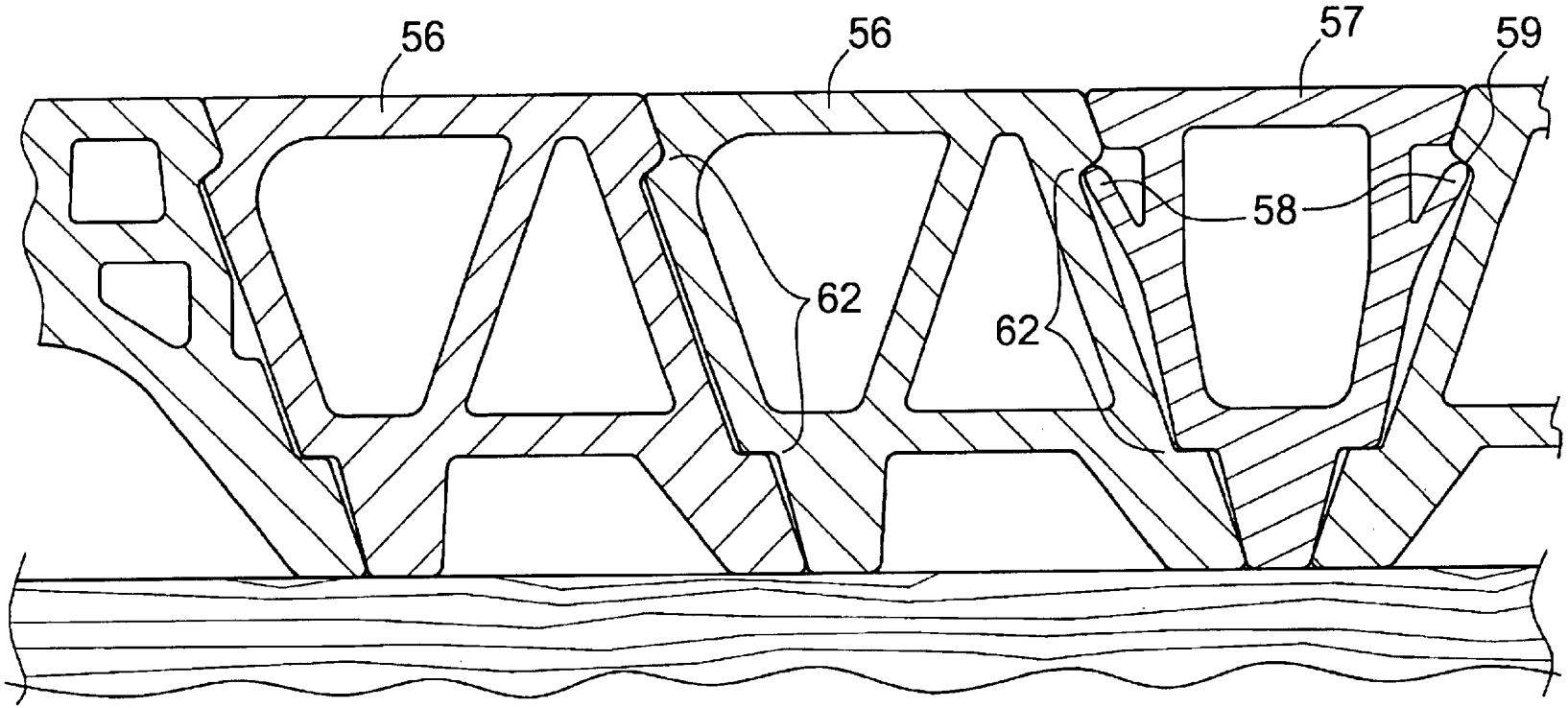
FIG. 5 shows another between-rails-roadway that embodies the invention.

FIG. 5 shows an embodiment in which the primary-strips 56 are locked to each other against relative vertical movement, but only the middle locking-strip 57 offers a snap-in latch connection. All the interface connections between the edges of the strips comprise tongue-and-groove connections. In FIG. 5, the primary-strips are first assembled into two horizontal stacks, with a gap between, and then the locking-strip 57 is driven down until the latch-levers 58 snap under the latch-ledges 59.

The number of primary-strips 56 might have to be increased, in FIG. 5, to keep the extruded profile within the 25 cm limit to the circumscribing circle.

In FIG. 5, the locking-strip 57 is tall enough to extend right down to the cross-tie 30. Because the primary-strips 56 do not include deflectable levers, there has to be a gap between the two (horizontal) stacks of primary-strips, i.e a gap that extends right down to the tie. The purpose of the gap, given the tongue-and-groove type of interface connection 62 between the strips (in FIG. 5 as in the other examples), is to permit sideways-assembly of the primary-strips 56, to form the stacks. The locking-strip 57 fills that gap. In e.g FIG. 1, where there is no gap between adjacent primary-strips, of course the primary-strips cannot be assembled together laterally.

Figure 6:
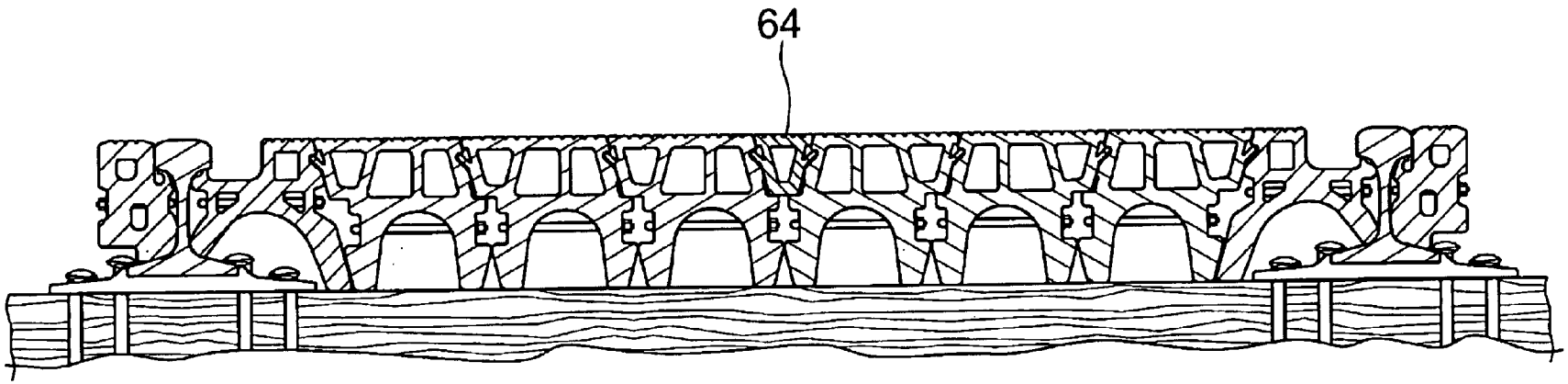
FIG. 6 shows another between-rails-roadway that embodies the invention.

FIG. 6 shows another example in which only one locking-strip 64 is used.

The lengths in which the extrusions can be produced is limited, not so much by the extrusion process, but by the apparatus in which the extruded lengths are to be vulcanised and cured. Also, the strips have to be transported, on a truck, to the road-rail crossing site, and lifted down from the truck. These limitations generally mean that the practical maximum length in which the strips can be made is about five metres, and the practical maximum weight is 100 kg.

Few crossings are narrow enough that five-metre strips will span across the whole width of the crossing, so the general rule, at most crossings, is that the five-metre strips have to be joined end-to-end.

Preferably, the end-to-end joints between strips should be at locations where the joint itself is not driven over by the wheels of passing vehicles; if the joint is in the centre of the roadway, for example, between two lanes of traffic, the joint will hardly ever be driven over. It is common for road-rail crossings to be provided in respect of two-lane roads. While crossings on four-lane highways of course do exist, the tendency is for highway crossings to be replaced by bridges. Two of the five-metre lengths of the strips, placed end-to-end, are very well suited to the needs of a two-lane crossing. The primary-strips should be cut to the exact required length at the factory, not on-site. The (smaller) locking-strips may be cut to size on-site.

The lengths may be mechanically joined together, and one manner of forming the joint is by means of U-shaped staples, as disclosed in FIGS. 3 and 4 of the above-mentioned U.S. Pat. No. 5,899,379. Alternatively, the strips can be glued together. However, this is not favoured because the adhesive would have to be applied on-site, and inspection would be difficult.

As mentioned, some means generally has to be provided for preventing the between-rails-roadway from wandering, over a period of time, along the rails, i.e laterally across the road. The means for constraining the between-rails-roadway against this tendency may comprise buffers attached to cross-ties at the edges of the crossing. Such buffers, if provided, would serve also to constrain the end-to-end strip lengths from coming apart, even in the absence of staples, glue, or the like.

It will be understood that the locking-strips, residing tightly within and between the primary-strips, provide a very large friction force, and this can be harnessed to hold the end-to-end primary-strips together. That is to say, in FIG. 1 for example the force needed to drag the locking-strip in the direction out of the plane of the drawing, against friction, would be high indeed. If the locking-strips are arranged to bridge between the end-to-end primary-strips joints, that resistance will prevent the primary-strips from separating. The designer may therefore prefer to stagger the end-to-end joints between the locking-strips with respect to the end-to-end joints between the primary-strips.

It takes a good deal of force to drive the locking-strips downwards until they snap down into position between the primary-strips. The heaviness of this force is advantageous in that it takes even more force to take the locking-strips out, making the long-term integrity of the between-rails-roadway at the crossing comparable to the rest of the roadway. When a crossing is subject to snow-plowing, it must be assured that even a clumsy plow-operator cannot dislodge the strips.

When the time comes to dismantle the between-rails-roadway, the locking-strips can then be levered out using a heavy crow-bar.

FIGS. *7a–7c* show an end-cap 70, which is used to retain the ends of the rubber strips. The end-cap 70 serves to prevent the ends of the strips from lifting, and serves to prevent the strips from creeping along the rails, which they can sometimes tend to do over a long period.

The end-cap 70 has projections 72 which extend towards the strips. The projections 72 engage into the cavities 73 (FIG. 2) which are extruded into the profile of the locking strips. There are as many projections as locking strips; the designer may provide projections for the primary strips as well, but that is less important. The end-cap 70 is also provided with a ramp 74. The lip 75 of the ramp fits over the ends of the rubber strips. Once the ramp has been assembled over the ends of the strips, it can be tightened down by means of screw-hooks 76.

The end-cap 70 has bars 78 which extend parallel with, and between, the rails. The bars 78 have holes 79, whereby the bars can be lag-screwed down to the (wood) cross-ties. Usually, the cross-ties are spaced 80 cm or so apart at crossings, and it is an easy matter for the designer to ensure that the holes 79 will always match up with two ties.

Some further points concerning the use of separate strips as a between-rails-roadway will now be described.

A major benefit of using separate individual strips is that narrow strips are relatively to easy to make, by extrusion. The conventional rubber insert-strips 23 as described herein are extruded, and are highly satisfactory in that application. A manufacturer of insert-strips for road-rail crossings already has the extruding equipment and expertise for making extrusions that have a circumscribing circle of 25 cm or so, and, as described herein, it is not difficult to design the roadway strips with a compatible size of profile. Thus, extruding the strips for the between-rails-roadway is compatible with the conventional operation of extruding the insert strips. On the other hand, extruding the between-rails-roadway as a one-piece slab would be, if not quite impractical, very much more difficult than extruding the relatively-narrow strips.

Extrusions within the 25 cm size can readily be controlled as to predictability of properties, uniformity of properties, and quality in general. This kind of extrusion is an especially controllable process, from the standpoint of high quality. By contrast, for making long, thin strips, a moulding process would be contra-indicated, because of quality-control problems.

Moulding processes might be more suitable if the between-rails-roadway were to be formed as a one-piece slab. Extrusion is favoured because of it permits excellent controllability over quality, but really only when the between-rails-roadway is made up of separate individual strips, each of which are within the 25 cm profile size.

Manufacturing the strips as extrusions enables the strips to be of intricate shape. Thus, the designer can provide a shape or profile that maximises the ability of the strip to support vehicles passing over the crossing, and yet minimises the mass of the profile needed to achieve that performance.

The designer should provide that the strips are identical, which is important not just for economy of tooling, but so the installer does not have to sort the strips out on site. Where they are not identical, there should be clear and obvious differences, as there are between the primary-strips and the locking-strips.

Not only should the cross-sectional profile of the strip be easily encompassed within the circumscribing circle (preferably no more than 25 cm diameter) but the profile should be reasonably uniform within that circle. A shape that is more or less symmetrical in all orientations is best. To be avoided would be a profile that comprises a single long, thin arm extending from a single large mass. Some of the profiles as described herein have protruding arms, but they are arranged more or less symmetrically, and are chunky in shape, and quite in keeping with the high-quality extrusion process.

It is a key aspect of the invention, given that separate long, thin strips are to be used for the between-rails-roadway, that a system must be provided for locking the side-faces of the strips together, and the locking system should be such as to make the assembly (or horizontal stack) of strips perform, in service, as if it were a single one-piece slab. The strips have to bridge over the spacings between adjacent cross-ties, which can be a distance of a metre, or even more, without buckling or even sagging, and without bouncing and rebounding. Having extruded the pieces in separate strips, for the good manufacturing reasons, now the strips have to be held together, as if they were all one panel.

The invention provides a coherent horizontal stack of strips, and provides strips of such structure that the strips can be assembled downwards, from above, between the rails, and can be locked together. It is emphasized that even the last strip to be assembled can be assembled downwards, and can be locked in place in the gap between the two adjacent strips.

The use of the locking-strips as described herein permits the assembly of strips to behave as one panel. If one strip should rise vertically, the adjacent strips are urged upwards also. Thus, the whole assembly acts as one panel. However, the assembly of strips has little torsional stiffness, and that is advantageous, because if any one of the strips does rise, that movement is accompanied by a (slight) rotation of the adjacent strips relative to each other. Such rotation involves rubbing movement of the strips one on another, and the friction associated with such rubbing is effective to damp out the movement.

The assembly of the strips effectively into a coherent single panel, as described herein, relies on the fact that the strips cannot move apart laterally, the horizontal stack of strips being held together by the rails. The between-rails-roadway, comprising the strips, must be assemblable from above. In the systems as described herein, the primary-strips are simply laid flat on top of the cross-ties, and then the locking-strips are simply driven downwards into place. It is a major factor, in the designs, that the interface connections between the sides of the strips include deflectable latch-levers, which snap into engagement with complementary latch-ledges, upon the locking-strips being driven down vertically, whereby the tongue-and-groove type of connection is achieved without the need for assembly to be done laterally.

Although the between-rails-roadway is delivered to the crossing site very much as separate components, which have to be assembled on site, that assembly is very rapid and straightforward, and is well within the capability of a working crew, even if the crew have never done the job before. And all the components of the finished roadway are visible, after assembly, whereby an inspector can very easily determine whether assembly is done properly.

The structure for a between-rails roadway as described herein is suitable for low-road-traffic crossings on main-lines, such as remote narrow side-road crossings, farm-crossings, etc. It is also highly suitable for pedestrian crossings, at stations etc. Especially for pedestrian crossings, it is advantageous for the upper surface of the strips to have grit or other non-slip aids embedded therein, which can be done as an adjunct to the extrusion process. It can also be advantageous, with pedestrian crossings, if the locking-strips can be provided in a different colour from the primary-strips. Sometimes, adding colour can affect the properties of extruded rubber, and it is preferred that the coloured (e.g white) strips be the locking strips.

The invention is also suitable where the crossing must stand up to a harsh environment, where the designer can arrange the composition of the extruded rubber to suit the conditions. In the case of farm-crossings on main lines, the duty may be such that the crossing remains pristine. However, since the track is a main line, the track bed has to refurbished every couple of years or so, all along its length. Re-setting the track-bed ballast requires taking out all the crossings on the main line. So, on a main line, even the still-pristine crossings have to be taken up, and then replaced, every few years. Therefore, the task of taking up the crossing must be inexpensive and simple and quick, as must the task of replacing the crossing after the track bed work has been done. The invention provides these benefits, and the more remote the crossing, and the more difficult to get heavy equipment to the site, the more the roadway system of the invention will be preferred.

The cross-sectional profile of the extruded rubber strips can be changed in accordance with the needs of the crossing. Thus, the strips at a pedestrian crossing can be of a light section, whereas a farm-crossing needs strips of a more chunky, robust, section. As mentioned, the composition of the rubber can be adjusted to suit conditions.

The needs of the extrusion process should be addressed. The profile of the primary strips, as shown in FIG. 2, for example, should be extruded upside down; if extruded right way up, the heavy upper section might lead to sagging of the legs 43 while the rubber is curing. On the other hand, if the roadway portion on the roof 42 of the primary strip were narrow, as may be preferred from the anti-tipping standpoint, it may be preferred to extrude the strip right way up.

The invention provides a roadway that is easy to remove and replace, and it may be noted that this ease has been achieved without compromising other aspects of the performance of the crossing. The invention is highly suitable for main-line applications. Furthermore, the same manner of constructing the roadway, as described herein, is suitable for pedestrian crossings, or for heavy road-traffic crossings, on main-line tracks. Although main-line crossings are replaced every few years, and a long service life may therefore be low on the list of priorities, the roadway of the invention still may be expected to last for decades, even if completely neglected. Thus, the invention is also suitable for crossings on little-used sidings, etc. The invention may even be used on crossings that combine heavy road traffic with main-line rail traffic (although crossings in that category have now mostly been replaced by bridges).

The techniques as described herein, of providing side-by-side extruded rubber strips with in-profile side-connectors, can also be used in respect of the field side, i.e the outside, of the rail tracks. However, the resistance to up/down movements, strip to strip, as provided in the invention, depends on the strips not being able to move apart laterally. Constraining the strips against lateral separation is easy to achieve when the strips are between the rails, because of course the rails themselves hold the strips together, to a very well-defined width apart.

But when the strips are provided on the outside of the rails, something is needed to hold the strips together, and to hold them against the rail. As shown in FIG. 8, preferably the roadway itself, beyond the crossing, comprises a concrete slab 80, and the slab has an end face 82 a distance G outside the rails, defining an open space into which the strips 83 can fit. Thus, the strips are confined, laterally, in the gap G between the end face 82 of the concrete slab and the rail 84. This distance G may be, say, half a meter or two feet.

However, the end face 82 of the concrete slab will not be accurately and uniformly located with respect to the rail 84, i.e the gap G may vary. So, the designer may provide that, after the strips 83 have been laid in the gap G, that the stack of strips is then crow-barred tightly against the outside of the rail 84; this opens up a small gap H between the end face of the slab and the outermost strip. It is a simple task then to fill the small (but variable) gap H with grout 85.

The resulting roadway is good enough for infrequent heavy (farm) traffic, and for pedestrian applications. Thus, where such crossings are provided on main lines, the designer may specify that a concrete slab be provided, with its end face positioned, for example, just at the ends of the cross-ties 86. The gap G between the end face and the rail is made a little larger than an appropriate number of the strips 83, and the concrete slab is there mainly for the purpose of holding the strips in place. Beyond the slab (i.e to the right in FIG. 8), the roadway may be made in another manner, e.g asphalt, gravel, or the like.

Thus, a complete crossing may be made by providing respective concrete slabs positioned to leave gaps G on the field sides of the rails; then, strips as in FIG. 1 may be provided between the rails, and strips as in FIG. 8 outside the rails. Such a crossing is very robust, and most unlikely to fail in any way, and yet the crossing can easily be dismantled, and replaced, by a small crew, re-using substantially all of the component parts.

As mentioned, the problem of how to fill the between-rails gap has been a difficult one for the designer. One conventional approach to the problem has been to place a large concrete-pad into the between-rails gap. But concrete pads are expensive, and are prone to cracking if the cross-ties are not all exactly at the same level. Also, concrete pads typically weigh a ton, which can be very inconvenient in the case of farm crossings and the like.

Filling the between-rails gap with asphalt also has problems, in that a means has to be provided for separating the asphalt away from the rails, and for keeping the asphalt from crumbling. Also, asphalt has to be taken up, and re-applied from scratch, each time maintenance work is done on the crossing.

All too often, therefore, the problem of filling the between-rails gap has been addressed by what may be termed the crossing-logs approach. Here, logs (of wood, or other material) are laid in parallel rows, between the rails. The problem is that, when a truck passes over the logs, the logs move up/down, relative to each other. If the truck is travelling at any more than walking pace, the logs can bounce and rebound, and settle back in a different position. Indeed, the strips can be dislodged out of position simply by pedestrian traffic, especially if people have been walking over the crossing for a prolonged period of time.

The expert, reviewing the crossing-logs problem, concludes that the logs need to be bolted down to the cross-ties. Indeed, fastening rows of logs down onto the cross-ties, with lag-bolts, and by other means, has sometimes been done.

However, making holes for fasteners in the cross-ties carries its own huge problems. To hold the logs down properly, each log would have to be fastened to each tie. Each fastener would have to be substantial enough to hold the log in place, even though subject to the occasional over-loaded axle passing over the crossing. The fasteners cannot be allowed to work loose, because the looseness would snowball, leading perhaps to ripping or other damage to the tie. This is not acceptable for siding-crossings, where the ties might not be repaired, or even inspected, for decades. It is even less acceptable for main-line crossings, where the track standards are so much higher.

The expert knows that no commercially-practical fastener has been devised for fastening crossing-logs to cross-ties. Thus, although experts conclude that the crossing-logs must be held down, they know of no acceptable way of attaching them to the ties.

It may be noted that laying separate rubber strips in rows side by side, but not fastened, would hardly be better than the logs. But with rubber strips, especially extruded rubber strips, different shapes can readily be imparted to the profiles of the strips, and side-fasteners can be incorporated into the profiles, whereby the fasteners run all along the lengths of the strips.

Extruded-profile rubber strips can easily be provided with side-connectors, between the strips, which serve to make a mechanical connection between the strips, connecting them together, side by side. The connections run along the full lengths of the strips, connecting the sides of the strips together uninterruptedly over their full lengths. The connections are highly robust, and yet cost virtually nothing over and above the basic cost of the strips.

As mentioned, it is recognised that such connections between the strips can convert a number of separate strips into an integrated or unified coherent assembly. Because the strips are held together as an assembly, they behave more in the manner of a (flexible) one-piece pad than as rows of separate logs. It is recognised that a set of strips that are fastened together along their side edges, in this manner, do not need to be held down, by fasteners, to the cross-ties.

(The designer should seek to avoid any type of fastener that requires holes to be made in railway cross-ties. The larger the hole, and the more holes, so much the worse. The fasteners for the end-caps 70, as described herein, if provided, can generally be much lighter than the fasteners that would have to be provided to hold individual strips to the ties, and only a much smaller number are needed.)

It may be noted that the side-connectors along the side-edges of the strips, as described, give little resistance to what may be termed a trough-mode of deflection, or inverted-trough-mode, of the assembly of strips (i.e the mode of deflection in which the assembly of strips deflects to a domed (convex), or inverted-dome (concave), configuration, when viewed in the direction of the rails, when a heavy truck passes over the crossing). As mentioned above, there is no requirement for the side-connectors to be able to resist twisting of the assembly of strips, and it is recognised that the side-connectors do not have to resist the trough-mode of deflection, either. It is enough that the side-edges of the strips be locked together, thereby preventing up/down movement relatively between the strips. That is enough to enable the assembly of strips, thus locked together, to form a unified coherent assembly.

When the strips are connected together in the manner as described, any trough-mode deflection that does take place, e.g when a truck passes over the crossing, then generally has a low amplitude, and in any event all the strips in the assembly of strips tend to settle back into the same positions they had before the truck passed over. It is recognised that it does not matter if one strip can pivot or rock (slightly) with respect to its neighbours; the important aspect is that if one strip rises or falls, its neighbour must also rise or fall, in unison. It is recognised that an assembly of strips connected together all along their side edges, in a manner which constrains the strips against relative up/down movement therebetween, behaves like a single coherent unit, in substantially every respect that affects the ability of the strips to function as a between-rails roadway.

At some crossings, the railway tracks follow a (slight) curve. The strips, being of rubber, can follow the curve, as required.

It should be noted that just two strips, locked together, between rails, would not be an example of the invention. With only two strips, the strips would in any event be prevented from up/down bouncing, simply by their engagement with the sides of the rails, whether or not their engaging side-edges were connected together. The invention aims to convert a row of several (i.e three or more) relatively thin strips into enough of a coherent whole unitary assembly that the assembly can function as a between-rails roadway.

What is claimed is:

1. Apparatus comprising a roadway at a road-rail crossing, wherein:

the apparatus includes a set of N strips, where N is a number greater than two;

each strip is of a long, thin configuration;

the N strips reside lengthwise, adjacent to each other in parallel rows, resting on the cross-ties;

the apparatus includes a eat of N-1 strip-side-connectors, which are effective to create respective mechanical connections between adjacent strips;

the strip-side connectors, and the mechanical connections created thereby, extend lengthwise along the side edges of the strips, whereby the length of a side-edge of one strip is connected to the length of a side-edge of the adjacent strip;

the nature of the mechanical connection between adjacent stripe, as created by the side-strip-connectors, is such that the mechanical connections are effective to ensure that, when one of the strips undergoes vertical movement, up or down, the strip or strips adjacent to the one strip are constrained, by the side-strip-connectors, to follow that vertical movement, substantially without slack or free-play;

the arrangement of the strip-side-connectors in the apparatus is such that, in respect of each one of the strips, any up/down movement undergone by the one strip is transmitted to, and reproduced, without slack or free-play, in, the strip or strips adjacent to that one strip, substantially all along the length thereof;

the arrangement of the side-strip connectors in the apparatus is such that, in respect of all the N strips taken together, the N stripe, thus connected, form an integrated unitaly whole roadway, in supporting road traffic passing over the crossing;

at least some of the strips are formed of a hard elastomeric material, and have a cross-sectional profile characterisable as thick and chunky, and the strips are so dimensioned and arranged that the set of strips as a whole is able to support the weight of traffic passing over the crossing;

the set of N strips includes a locking-strip, and a set of P primary-strips;

the primary-strips are so profiled that, when all the primary-strips are resting on the cross-ties, a gap is created between a pair of adjacent primary-strips, and the locking-strip is profiled to fit into that gap;

the locking-strip is so structured as to be capable of being driven, from above, downwards into the gap;

the apparatus includes a latching means;

the latching means is so disposed as to act between the locking-strip and at least one of the adjacent primary-strips;

the latching means includes a latch-lever and a latch-ledge, one on the locking-strip and the other on the said one of the adjacent primary-strips, and the latching-means is so structured and arranged that, upon the locking-strip being driven down into the gap, the latch-lever snaps over a lip of the latch-ledge, and thereby locks the locking-strip to the said one of the adjacent primary-strips.

2. Apparatus of claim 1, wherein the strips are arranged to rest on the cross-ties without being fastened down onto the cross-ties, to the extent that the strips are not restrained, by being fastened to the cross-ties, from rising up from the cross-ties, at least along the major part of the lengths of the strips.

3. Apparatus of claim 1, wherein the apparatus includes an end-cap;

the apparatus includes a means for anchoring the end-cap to the cross-ties;

the end-cap is so structured as to engage with the ends of the strips, and to constrain the strips from moving longitudinally with respect to the rails.

4. Apparatus of claim 1, wherein the locking-strip is of a visibly-different colour from the primary-strips.

5. Apparatus of claim 1, wherein the strip-side-connector make mechanical connection between the adjacent strips, along the whole length thereof, substantially without gaps.

6. Apparatus of claim 1, wherein:

the roadway comprises P primary-strips, which are so profiled that P—1 gaps are present between adjacent pairs of primary-strips;

the apparatus includes P−1 locking-strips, each locking-strip has respective left and right latch-levers;

the primary-strips have respective complementary latch-ledges.

7. Apparatus of claim 6, wherein each primary-strip includes, as aspects of the profile of a single piece of material:

a pair of legs of the primary-strip, which rest on the cross-ties;

a roof of the primary-strip, which forms a portion of the roadway of the crossing;

a structurally-sturdy support means, for transferring the weight of vehicles passing over the said portion of the roadway down, through the legs, onto the cross-ties.

8. Apparatus of claim 7, wherein:

the primary-strips include abutments, and the locking-strips rest on the abutments;

each locking-strip includes, as an aspect of its profile, a roof thereof, which forms a portion of the roadway of the crossing;

the abutments are so located in the primary-strips to be capable of transferring the weight of vehicles passing over the said portion of the roadway down, through the legs, onto the cross-ties.

9. Apparatus of claim 1, wherein each strip is of constant cross-sectional profile along its length.

10. Apparatus of claim 9, wherein the strips are extrusions.

11. Apparatus of claim 1, wherein the arrangement of the apparatus is such that each one of the strips comprising the roadway is light enough to be picked up and manhandled and placed between the rails, separately from the other strips.

12. Apparatus of claim 10, wherein each of the strips has a cross-sectional profile that lies within a circumscribing circle having a diameter of about twenty-five centimetres.

13. Apparatus of claim 1, wherein the roadway comprises a between-rails roadway, in that the strips reside between the rails.

14. Apparatus of claim 1, wherein:

the roadway comprises a between-rails roadway;

the set of N strips includes P primary-strips;

the set of N strips includes, in addition to the P primary-strips, left and right rail-strips, which are in direct touching contact with the left and right rails;

the set of N strips includes a number L of locking-strips, which includes the said locking-strip.

15. Apparatus of claim 14, wherein the number L =P+1, the P+1 locking strips being intercalated between the P primary-strips and the rail-strips.

16. Apparatus of claim 14, wherein the number P is between four and eight, inclusive.

17. Apparatus of claim 14, wherein N is fifteen, P being six, and L being seven.

18. A road-rail crossing, having a between-rails roadway of a structure that fails within the scope of claim 13, the crossing includes a slab of concrete, which forms a portion of the roadway outside the rails;

the slab has an end-face that is so located as to define a gap G between the end-face and the field side of the nearest rail;

a set of three or more strips laid side by side, in rows, in the gap G;

where the edges of the strips are mechanically connected together, in such manner that the strips cannot undergo relative up/down movement.

19. Apparatus of claim 1, wherein:

an extreme left strip of the set of N strips is in contact with the left rail, and engages laterally between the head and the flange of the left rail, being thereby constrained against vertical movement, in both vertical senses, relative to the left rail; and an extreme right strip of the set of N strips is in contact with the right rail, and engages laterally between the head and the flange of the right rail, being thereby constrained against vertical movement, in both vertical senses, relative to the right rail.

20. Apparatus of claim 1, wherein the strip-side-connectors are formed integrally into the side-edges of the material of the strips.

21. Apparatus of claim 1, wherein the primary strips rest on top of, and are in direct touching contact, with the cross-ties.

22. Apparatus of claim 1, wherein the latch-lever and the latch-ledge extend lengthwise along the side edges of the strips, substantially all along the length thereof.

23. Apparatus of claim 1, wherein:

the profile of the strip, which includes the latch-lever, includes a main bulk of the strip;

snapping of the latch-lever over the latch-ledge involves movement of the latch-lever relative to the main bulk of the strip; and the latch-lever comprises an arm that is thin enough to be able to flex relative to the main bulk of the strip, to accommodate the said movement.

24. Apparatus of claim 15, wherein the locking strips are of a visibly different colour from the primary-strips, whereby the between-rails roadway is visibly striped.

* * * * *